US009926877B2

(12) United States Patent
Omi

(10) Patent No.: US 9,926,877 B2
(45) Date of Patent: Mar. 27, 2018

(54) INJECTION CONTROL DEVICE

(71) Applicant: DENSO CORPORATION, Kariya, Aichi-pref. (JP)

(72) Inventor: Keita Omi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/345,960

(22) Filed: Nov. 8, 2016

(65) Prior Publication Data

US 2017/0159597 A1 Jun. 8, 2017

(30) Foreign Application Priority Data

Dec. 2, 2015 (JP) ..... 2015-236031

(51) Int. Cl.

| | |
|---|---|
| ***F02D 41/30*** | (2006.01) |
| ***F02D 41/28*** | (2006.01) |
| ***F02D 41/20*** | (2006.01) |
| *F02D 41/40* | (2006.01) |
| *F02D 41/14* | (2006.01) |

(52) U.S. Cl.

CPC ..... *F02D 41/30* (2013.01); *F02D 41/20* (2013.01); *F02D 41/28* (2013.01); *F02D 41/401* (2013.01); *F02D 2041/1432* (2013.01); *F02D 2041/2003* (2013.01); *F02D 2041/281* (2013.01); *F02D 2200/0602* (2013.01); *F02D 2250/14* (2013.01)

(58) Field of Classification Search

CPC ..... F02D 41/30; F02D 41/20; F02D 41/28; F02D 41/401; F02D 2041/1432; F02D 2041/2003; F02D 2041/281; F02D 2200/602; F02D 2250/14

See application file for complete search history.

(56) References Cited

U.S. PATENT DOCUMENTS

| | | | | |
|---|---|---|---|---|
| 7,281,509 | B2 * | 10/2007 | Fukui | F02D 41/062 123/179.16 |
| 7,913,667 | B2 * | 3/2011 | Tomoda | F02D 41/3094 123/456 |
| 9,422,884 | B2 * | 8/2016 | Fujii | F02D 41/247 |
| 2006/0196475 | A1 | 9/2006 | Tomoda et al. | |

FOREIGN PATENT DOCUMENTS

| | | | |
|---|---|---|---|
| JP | 2007-315309 | A | 12/2007 |

* cited by examiner

*Primary Examiner* — Hieu T Vo
(74) *Attorney, Agent, or Firm* — Posz Law Group, PLC

(57) ABSTRACT

An injection control device of the present disclosure includes a control section that controls a fuel injection of an injector and a filter to which a sensing signal of a fuel pressure sensor to sense a fuel pressure of the injector is inputted. The filter includes a first filter and a second filter which is higher in a cut-off frequency than the first filter. The control section determines a fuel injection start timing, at which the injector is opened to start injecting the fuel into the internal combustion engine, by a crank angle and calculates a valve opening output to bring the injector from a closed state to an opened state on the basis of the sensing signal. Further, at an earlier timing, which is earlier than the fuel injection start timing by a calculation time required to calculate the valve opening output, the control section samples the sensing signal via the second filter and calculates the valve opening output on the basis of the sampled sensing signal.

4 Claims, 4 Drawing Sheets

INJECTION CONTROL DEVICE

CROSS REFERENCE TO RELATED APPLICATION

This application is based on Japanese Patent Application No. 2015-236031 filed on Dec. 2, 2015, the disclosure of which is incorporated herein by reference.

TECHNICAL FIELD

The present disclosure relates to an injection control device that controls an injector.

BACKGROUND

As described in JP 2007-315309 A, there has been known a fuel injection control device that controls a fuel injection amount of an injector. A fuel injection amount of the injector is determined by a fuel pressure in a delivery pipe and a valve opening period of the injector. The fuel injection control device calculates the fuel pressure in the delivery pipe and calculates the valve opening period of the injector on the basis of the calculated fuel pressure. Further, the fuel injection control device performs a feedback control in such a way that the fuel pressure in the delivery pipe is made constant.

The fuel injection control device calculates the fuel pressure in the delivery pipe at a given period and calculates the fuel pressure at the given period irrespective of a fuel injection start timing. For this reason, an error is caused between the calculated fuel pressure and the fuel pressure at the fuel injection start timing. The fuel injection control device corrects the fuel injection amount on the basis of a history of the fuel pressure, but a valve opening period of the injector is likely to be made excessively long or short because of the error. For this reason, the fuel injection amount outputted from the injector is likely to be shifted from an aimed fuel injection amount.

SUMMARY

It is an object of the present disclosure to provide an injection control device in which a calculation accuracy of a fuel injection amount is inhibited from being deteriorated.

According to one aspect of the present disclosure, an injection control device includes: a control section that controls an injector to inject fuel into an internal combustion engine; and a filter to which a sensing signal of a fuel pressure sensor to sense a pressure of the fuel to be supplied to the injector is inputted. The filter includes a first filter and a second filter that is higher in a cut-off frequency than the first filter.

The control section determines a fuel injection start timing, at which the injector is opened to start injecting the fuel into the internal combustion engine, by a crank angle and calculates a valve opening output to bring the injector from a closed state to an opened state on the basis of the sensing signal. The control section samples the sensing signal via the second filter at an earlier timing, which is earlier than the fuel injection start timing by a calculation time required to calculate the valve opening output, and calculates the valve opening output on the basis of the sampled sensing signal.

The degree of difficulty in opening the injector depends on the pressure of the fuel (fuel pressure) to be supplied to the injector. Hence, it is recommended to calculate the valve opening output to bring the injector from the closed state to the opened state on the basis of the fuel pressure at the fuel injection start timing. However, the calculation time is required so as to calculate the valve opening output. Hence, as described above, in the present disclosure, the valve opening output is calculated on the basis of the fuel pressure at the earlier timing that is earlier than the fuel injection start timing by the calculation time. According to this, as compared with a construction in which the valve opening output is calculated on the basis of the sensing signal of the fuel pressure sampled at a given period irrespective of the fuel injection start timing, the valve opening output can be calculated on the basis of a value close to the fuel pressure at the fuel injection start timing. For this reason, a valve opening start time of the injector is inhibited from being shifted.

A fuel injection amount of the injector is determined by the fuel pressure described above and a valve opening period of the injector. In contrast to this, as described above, the valve opening start time of the injector is inhibited from being shifted. For this reason, the valve opening period is inhibited from being shifted. As a result, a calculation accuracy of the fuel injection amount of the injector is inhibited from being deteriorated.

Further, the fuel pressure used for calculating the valve opening output is the sensing signal of the fuel pressure sensor via the second filter which is higher in a cut-off frequency than the first filter, that is, the sensing signal of which amplitude is inhibited from being reduced as compared with the sensing signal via the first filter. Hence, as compared with a construction in which the valve opening output is calculated by the use of the sensing signal via the first filter, the valve opening output can be calculated with higher accuracy.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Hereinafter, an embodiment in a case where an injection control device of the present disclosure is applied to an engine ECU will be described with reference to the drawings.

First Embodiment

Figure 1:
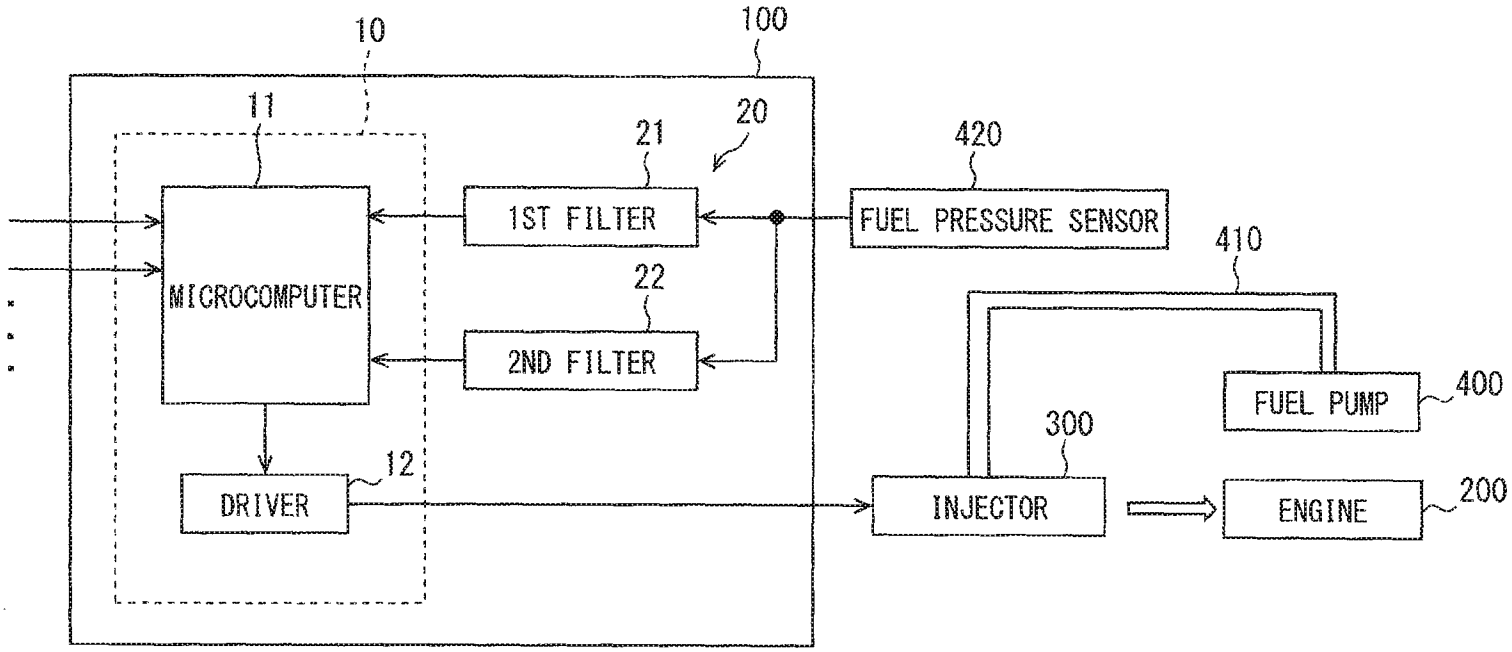
FIG. 1 is a block diagram to show a general construction of an engine ECU according to a first embodiment.

An engine ECU according to the present embodiment will be described on the basis of FIG. 1 to FIG. 3. FIG. 1 will show not only the engine ECU but also an internal combustion engine, an injector, a fuel pump, and a fuel pressure sensor. In the following, first, an internal combustion engine 200, an injector 300, and a fuel pump 400 will be described. Then, an engine ECU 100 will be described.

Although not shown in the drawing, the internal combustion engine 200 includes a crankshaft, a connecting rod, a piston, a cylinder, a plug, an intake pipe, an exhaust pipe, an intake valve, an exhaust valve, a camshaft, and a timing chain. The crankshaft and the piston are coupled to each other via the connecting rod, and the piston is moved up and down in the cylinder by the rotation of the crankshaft. A combustion chamber is constructed of the cylinder and the piston, and fuel is injected into the combustion chamber from the injector 300. Then, a spark is generated by the plug, whereby an air-fuel mixture made by mixing the fuel with air is combusted. In this way, the piston is moved up and down and a moving up and down motion is transmitted as a drive force to an output shaft of a vehicle from the crankshaft.

The combustion chamber has two openings formed therein. One of the two openings is coupled to the intake pipe and the other opening is coupled to the exhaust pipe. One of the two openings is provided with the intake valve and the other of the two openings is provided with the exhaust valve.

The camshaft is coupled to the crankshaft via the timing chain. Hence, when the crankshaft is rotated, the camshaft is also rotated together. The intake valve and the exhaust valve are moved up and down with respect to the openings of the combustion chamber along with the rotation of the camshaft. In this manner, the communication of the combustion chamber with the intake pipe and the communication of the combustion chamber with the exhaust pipe are controlled.

The internal combustion engine 200 according to the present embodiment is a 4-cycle engine that constructs one cycle of four strokes of an intake stroke, a compression stroke, an expansion stroke, and an exhaust stroke. In the intake stroke, the piston is moved from a top dead center to a bottom dead center and the intake valve is separated from the opening of the combustion chamber and the combustion chamber is made to communicate with the intake pipe, whereby air is made to flow into the combustion chamber. Further, at this time, the fuel in the form of mist is injected into the combustion chamber from the injector 300. In the compression stroke, the piston is moved from the bottom dead center to the top dead center and the intake valve is moved near to the opening of the combustion chamber and the communication of the combustion chamber with the exhaust pipe is blocked, whereby the air-fuel mixture is compressed in the combustion chamber. In the expansion stroke, a spark is generated by the plug and the air-fuel mixture is combusted. The piston is moved from the top dead center to the bottom dead center by this combustion. Finally, in the exhaust stroke, the piston is moved from the bottom dead center to the top dead center and the exhaust valve is separated from the opening of the combustion chamber, whereby the combustion chamber is made to communicate with the exhaust pipe. In this way, the exhaust gas in the combustion chamber is exhausted to the exhaust pipe.

A start timing of each of the intake stroke, the compression stoke, the expansion stroke, and the exhaust stroke is determined by a rotation angle (crank angle) of the crankshaft. A timing (hereinafter referred to as "fuel injection start timing) when the fuel starts to be injected into the combustion chamber of the injector 300 is also determined by the crank angle. Although not shown in the drawing, the injector 300 has a solenoid coil and a needle valve. The opening and closing of the needle valve is controlled by passing current through the solenoid coil. In this way, the opening and closing of the injector 300 is controlled, whereby a fuel injection from the injector 300 is controlled. The passing of the current through the solenoid coil is controlled by the engine ECU 100. In this regard, the degree of difficulty in bringing the injector 300 into an opened state from a closed state depends on a pressure of the fuel to be supplied to the injector 300 (hereinafter referred to as "fuel pressure"). Hence, as will be described later, the current to be supplied to the solenoid coil of the injector 300 is determined according to the fuel pressure.

As described above, in the intake stroke, the fuel is injected into the combustion chamber from the injector 300, and the fuel is supplied to the injector 300 from a fuel pump 400 shown in FIG. 1 via a delivery pipe 410. The fuel pump 400, although not shown in the drawing, has a plunger, a cylinder, an electromagnetic spill valve, a check valve, and a spring. The plunger is moved up and down in the cylinder in cooperation with the rotation of the camshaft. The cylinder is coupled to a fuel tank (not shown in the drawing) via the electromagnetic spill valve. Further, the cylinder is coupled to the delivery pipe 410 via the check valve. A fuel chamber that stores the fuel is constructed of the plunger and the cylinder and when the plunger is moved up and down, the volume of the fuel chamber is varied. As a result, the amount of the fuel stored in the fuel chamber is also varied.

The plunger is moved up in the cylinder by a pump cam of a camshaft while resisting a restoring force of the spring. In the case where the electromagnetic spill valve is opened, the fuel chamber is made to communicate with the fuel tank. Hence, even if the volume of the fuel chamber is decreased by the plunger being moved up, the fuel is returned to the fuel tank, so that the fuel in the fuel chamber is not pressurized. For this reason, the check valve is in a closed state and hence the fuel is not fed under pressure to the delivery pipe 410.

When the plunger is moved up to the top dead center in the cylinder and then starts to be moved down by the restoring force of the spring, the fuel is supplied to the fuel chamber from the fuel tank via the electromagnetic spill valve in an opened state. When the plunger is moved down to the bottom dead center in the cylinder and then starts to be moved up, the volume of the fuel chamber is decreased and the fuel is returned to the fuel tank from the fuel chamber via the electromagnetic spill valve.

When the plunger is moved up in the cylinder and the volume of the fuel chamber (a discharge amount of the fuel injected by the injector 300) reaches a target value suitable for an operating state of the vehicle, the electromagnetic spill valve is brought into a closed state. In this way, the fuel in the fuel chamber is pressurized and the check valve is brought into an opened state. As a result, the fuel brought into high pressure in the fuel chamber is fed under pressure to the delivery pipe 410 via the check valve. The opened and/or closed state of the electromagnetic spill valve is controlled by the engine ECU 100. The engine ECU 100 controls the electromagnetic spill valve in such a way that the pressure in the delivery pipe 410 is made constant.

Next, the engine ECU 100 will be described. As shown in FIG. 1, the engine ECU 100 has a control section 10 and a filter 20. The control section 10 can communicate with various kinds of ECUs arranged in the vehicle. Further, the control section 10 is electrically connected to various kinds of sensors arranged in the vehicle. As one of these sensors, a fuel pressure sensor 420 will be shown in FIG. 1. The fuel pressure sensor 420 senses the pressure of the fuel (fuel pressure) in the delivery pipe 410. A sensing signal of the fuel pressure sensor 420 is inputted to the control section 10 via the filter 20.

The filter 20 has a first filter 21 and a second filter 22. Each of the first filter 21 and the second filter 22 has a resistor and a capacitor, The second filter 22 is higher in a cut-off frequency than the first filter 21. Hence, an amplitude of the sensing signal of the fuel pressure sensor 420 via the second filter 22 is larger than an amplitude of the sensing signal of the fuel pressure sensor via the first filter 21. The sensing signals of the fuel sensor 420 via these filters 21, 22 are inputted to the control section 10.

As described above, the plunger of the fuel pump 400 is moved up and down in the cylinder according to the rotation of the pump cam of the camshaft. For this reason, the fuel supplied to the delivery pipe 410 from the fuel pump 400 is pulsated. The frequency of the pulsation is determined according to the number of revolutions of the pump cam. Hence, a signal level of the sensing signal of the fuel pressure sensor 420 is cyclically varied according to the pulsation of the fuel. The cut-off frequency of the second filter 22 is set at a frequency higher than the frequency of the sensing signal of the fuel pressure sensor 420 determined according to the number of revolutions of the pump cam when the internal combustion engine 200 is combusted and driven. In this way, the amplitude of the sensing signal of the fuel pressure sensor 420 via the second filter 22 is hard to be reduced.

The control section 10 has a microcomputer 11 and a driver 12. The microcomputer 11 calculates a valve opening timing (fuel injection start timing) of the injector 300 on the basis of the crank angle to be inputted from a crank angle sensor (not shown in the drawing). Further, the microcomputer 11 calculates a valve opening output to open the injector 300 on the basis of the sensing signal of the fuel pressure sensor 420 to be inputted via the second filter 22. Specifically, this valve opening output is a target value of a current to be passed through the solenoid coil of the injector 300. The microcomputer 11 outputs this valve opening output to the driver 12. The driver 12 passes the current through the solenoid coil in such a way that the current is close to the target value of the current (hereinafter referred to as "a target current value) included in the valve opening output. In this way, the injector 300 is brought from the closed state into the opened state and the valve opening state is held. In this regard, the microcomputer 11 calculates an amount of the fuel actually injected from the injector 300 on the basis of the sensing signal via the first filter 21.

Figure 2:
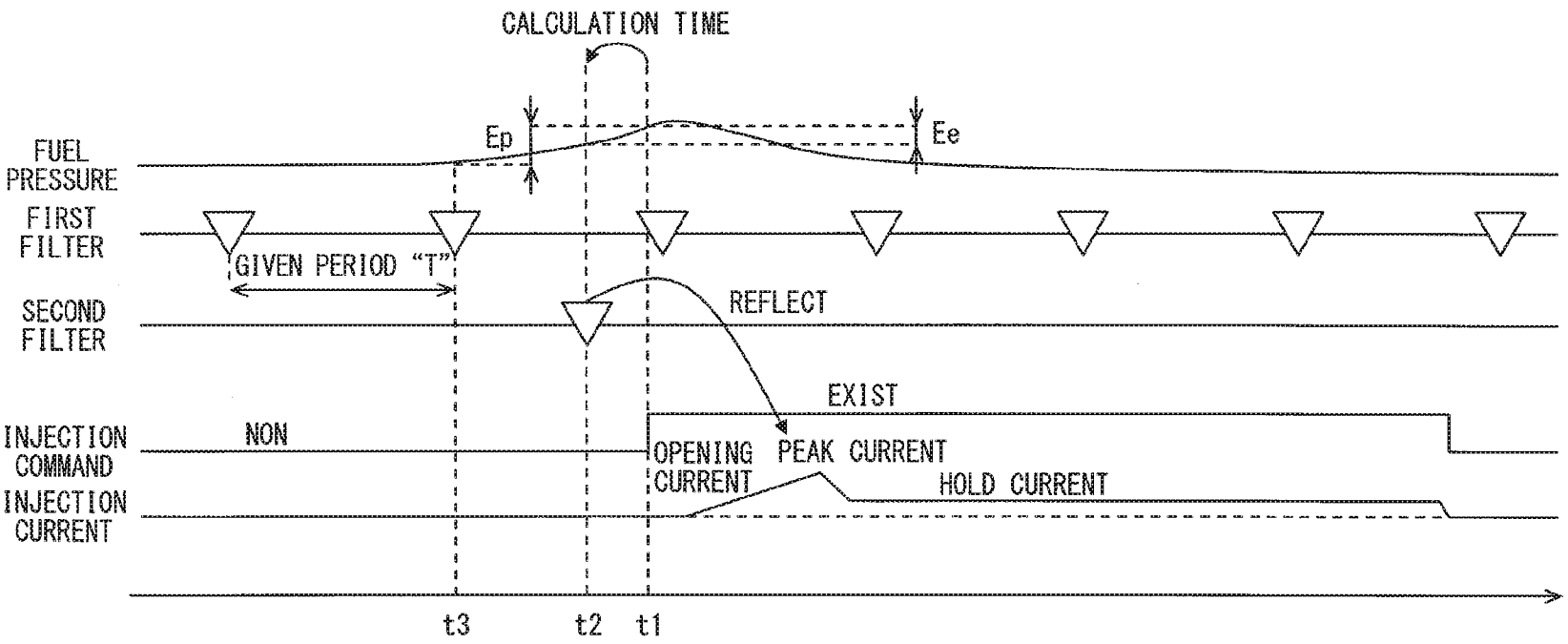
FIG. 2 is a timing chart to show a signal of the engine ECU.

The microcomputer 11 detects the sensing signal via the first filter 21 at a given period T, that is, at detection timings each shown by a triangle (∇) in FIG. 2. The microcomputer 11 detects a plurality of sensing signals via the first filter 21 when the fuel is injected by the injector 300. The microcomputer 11 calculates a fuel injection amount is of the injector 300 on the basis of an average value of the plurality of detected sensing signals. Further, the microcomputer 11 calculates a timing when the electromagnetic spill valve is opened or closed on the basis of the sensing signal via the first filter 21 in such a way that the pressure in the delivery pipe 410 is made constant.

The microcomputer 11 detects the sensing signal via the second filter 22 at an earlier timing earlier than the fuel injection start timing by a calculation time required to calculate the valve opening output. As described above, the fuel injection start timing is determined by the crank angle. The calculation time is stored previously in the microcomputer 11. Hence, the microcomputer 11 calculates the earlier timing on the basis of the calculation time after the fuel injection start timing is determined.

The microcomputer 11 stores a corresponding relationship between the sensing signal (fuel pressure) and the valve opening output (target current value). The corresponding relationship of the target current value to the fuel pressure is determined by the degree of difficulty in bringing the injector 300 into the opened state from the closed state. The microcomputer 11 calculates the target current value at the earlier timing on the basis of the sensing signal via the second filter 22 and the corresponding relationship described above. The microcomputer 11 outputs the target current value to the driver 12 along with an injection instruction. The driver 12 determines the current to be outputted to the solenoid coil in such a way that current corresponding to the target current value flows through the solenoid coil of the injector 300.

As shown in FIG. 2, the current (injection current) flowing through the solenoid coil of the injector 300 includes an opening current, a peak current, and a hold current. The target current value corresponds to a current value of the peak current (peak current value). The driver 12 outputs the current in such a way that the peak current flows through the solenoid coil. Then, the opening current in which a current value is gradually increased flows through the solenoid. The driver 12 controls the current in such a way that when the current flowing through the solenoid coil reaches the peak current, the hold current lower than the peak current continuously flows through the solenoid coil. When the opening current flows through the solenoid coil, the injector 300 is changed from the closed state to the opened state. Then, when the hold current flows through the solenoid current, the injector 300 is held in the opened state. The fuel injection amount injected into the combustion chamber from the injector 300 is determined by the pressure of the fuel (fuel pressure) to be supplied to the injector 300 and the valve opening period of the injector 300. Hence, an output period of current to the solenoid coil is determined by the fuel injection amount to be a target.

Next, a procedure of the microcomputer 11 will be described on the basis of FIG. 3.

In step S10, the microcomputer 11 calculates the fuel injection amount to be a target on the basis of an accelerator opening degree and the like outputted from the various kinds of sensors arranged in the vehicle. Then, the microcomputer 11 advances the procedure to step S20.

When the procedure proceeds to step S20, the microcomputer 11 determines the fuel injection start timing on the basis of the engine speed and the crank angle, which are outputted from various kinds of sensors arranged in the vehicle. The fuel injection start timing corresponds to time t1 shown in FIG. 2. Then, the microcomputer 11 advances the procedure to step S30.

When the procedure proceeds to step S30, the microcomputer 11 calculates the earlier timing on the basis of the fuel injection start timing determined in step S20 and the stored calculation time. Then, the microcomputer 11 advances the procedure to step S40.

In step S40, the microcomputer 11 determines on the basis of the engine speed and the crank angle whether the sensing timing reaches the earlier timing. In the case where the sensing timing does not reach the earlier timing, the microcomputer 11 repeats the step S40. In this way, the microcomputer 11 is brought into a waiting state until the sensing timing reaches the earlier timing. When the sensing timing reaches the earlier timing, the microcomputer 11 advances the procedure to step S50. This earlier timing corresponds to time t2 shown in FIG. 2.

When the procedure proceeds to step S50, the microcomputer 11 acquires the sensing signal via the second filter 22. Then, the microcomputer 11 advances the procedure to step S60.

When the procedure proceeds to step S60, the microcomputer 11 calculates the target current value on the basis of the sensing signal acquired in step S50 and the stored corresponding relationship. Then, the microcomputer 11 advances the procedure to step S70.

When the procedure proceeds to step S70, the microcomputer 11 outputs the target current value to the driver 12. Further, the microcomputer 11 outputs an injection instruction to the driver 12. In this way, the microcomputer 11 makes a current corresponding to the target current value flow through the solenoid coil of the injector 300 by the driver 12. In this regard, although not shown in the drawing, the microcomputer 11 outputs also the target current value related to the hold current to the driver 12. Then, when the valve opening period has elapsed, the microcomputer 11 stops outputting the target current value and the injection instruction to the driver 12.

Next, an operation and an effect of the engine ECU 100 according to the present embodiment will be described. As described above, the degree of difficulty in opening the injector 300 depends on the pressure of the fuel (fuel pressure) to be supplied to the injector 300. Hence, it is recommended to calculate the valve opening output to open the injector 300 (target current value) on the basis of the fuel pressure at the fuel injection start timing. However, the calculation time is required so as to calculate the target current value. Hence, as described above, the microcomputer 11 calculates the target current value on the basis of the fuel pressure at the earlier timing earlier than the fuel injection start timing by the calculation time. According to this, as compared with a construction in which the target current value is calculated on the basis of the sensing signal of the fuel pressure sampled at a given period irrespective of the fuel injection start timing, the target current value can be calculated on a value close to the fuel pressure at the fuel injection start timing. For this reason, the time when the injector 300 starts to be opened is inhibited from being shifted from the fuel injection start timing.

The fuel injection amount of the injector 300 is determined by the fuel pressure and the valve opening period of the injector 300. In contrast to this, as described above, the timing when the injector 300 starts to be opened is inhibited from being shifted from the fuel injection start timing. For this reason, the valve opening period of the injector 300 is inhibited from being shifted. As a result, the calculation accuracy of the fuel injection amount of the injector 300 is inhibited from being deteriorated.

For example, as shown in FIG. 2, in a case where the fuel pressure is detected at the given period T, a detection timing becomes t3. A difference between the fuel pressure detected at the timing t3 and the fuel pressure detected at the fuel injection start timing t1 becomes Ep. In contrast to this, in the case where the fuel pressure is detected at the earlier timing t2, a difference between the fuel pressure detected at the earlier timing t2 and the fuel pressure detected at the fuel injection start timing t1 becomes Ee. As shown clearly in FIG. 2, the earlier timing t2 is closer to the fuel injection start timing t1 than the detection timing t3 in the case where the fuel pressure is detected at the given period T, Hence, the difference Ee becomes smaller than the difference Ep. In this way, the difference between the fuel pressure at the fuel injection start timing t1 and the detected fuel pressure becomes smaller, whereby the timing when the injector 300 starts to be opened is inhibited from being shifted from the fuel injection start timing. As a result, the calculation accuracy of the fuel injection amount of the injector 300 can be inhibited from being deteriorated.

In this regard, it can also happen that the detection timing t3 is closer to the fuel injection start timing t1 than the earlier timing t2. However, in this case, an amount of time that elapses between the detection timing t3 and the fuel injection start timing t1 becomes smaller than the calculation time. Hence, it is impossible to calculate the fuel injection amount by the use of the fuel pressure detected at the detection time t3 within a period from the detection time t3 to the fuel injection start timing t1. As described above, also in this case, the calculation accuracy of the fuel injection amount of the injector 300 can be inhibited from being deteriorated.

Further, the fuel pressure used for calculating the target current value is the sensing signal of the fuel pressure sensor 420 via the second filter 22 which is higher in the cut-off frequency than the first filter 21, in other words, the sensing signal of which amplitude is inhibited from being reduced as compared with the sensing signal via the first filter 21. Hence, as compared with a construction in which the target current value is calculated by the use of the sensing signal via the first filter 21, the target current value can be calculated with higher accuracy.

Although a preferable embodiment of the present disclosure has been described above, the present disclosure is not limited to the embodiment described above but can be variously modified within a scope not departing from the gist of the present disclosure.

First Modification

In the first embodiment has been described an embodiment in which the microcomputer 11 calculates the target current value at the earlier timing. However, it is also possible to employ a construction which is different from the embodiment and in which the driver 12 calculates the target current value at the earlier timing.

Figure 4:
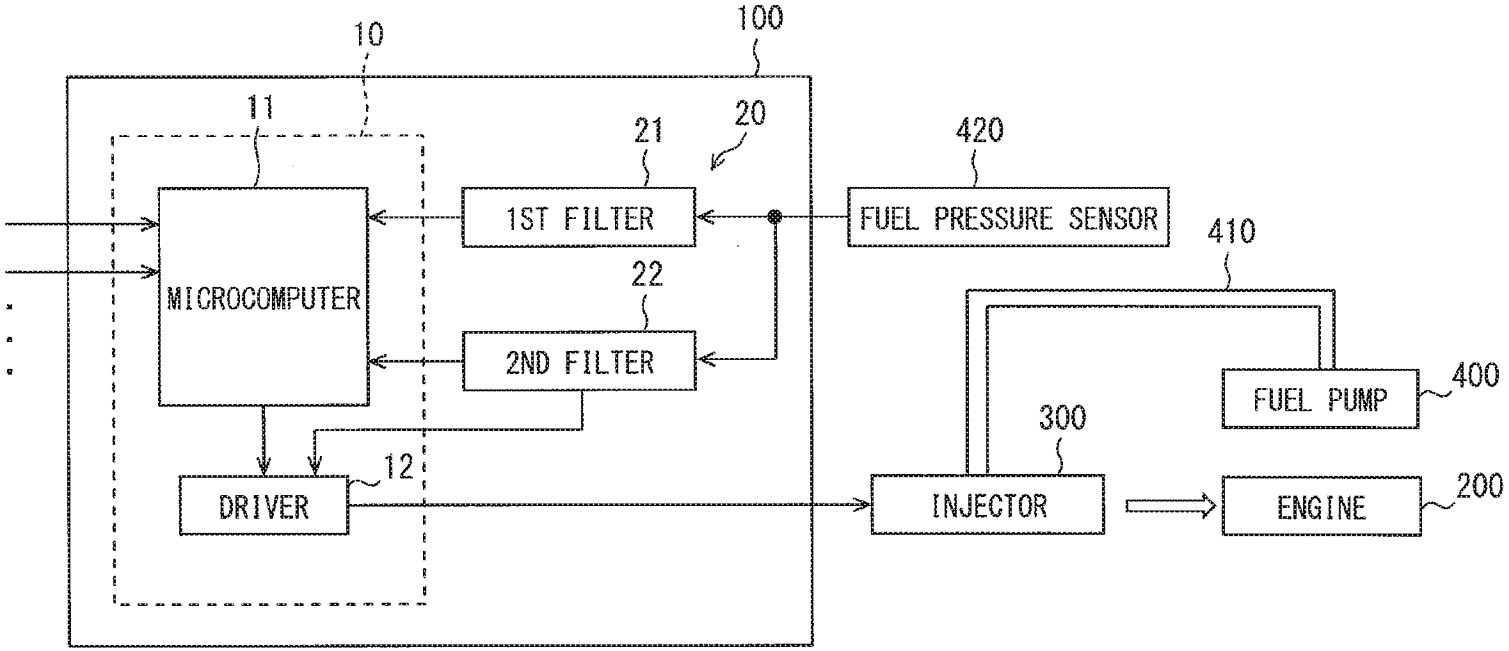
FIG. 4 is a block diagram to show a modification of the engine ECU.

In the case of this construction, as shown in FIG. 4, the sensing signal of the fuel pressure sensor 420 via the filter 22 is inputted to the driver 12. The microcomputer 11 calculates the earlier timing as described in the first embodiment. Then, the microcomputer 11 outputs a trigger signal to instruct a sampling operation to the driver 12, When the driver 12 receives the trigger signal, the driver 12 samples the sensing signal of the fuel pressure sensor 420 via the second filter 22. The driver 12 stores the corresponding relationship between the fuel pressure and the target current value. The driver 12 calculates the target current value on the basis of the sampled fuel pressure and the corresponding relationship. Then, the driver 12 lets current flow through the solenoid coil of the injector 300 in such a way that the current reaches the target current value.

Figure 3:
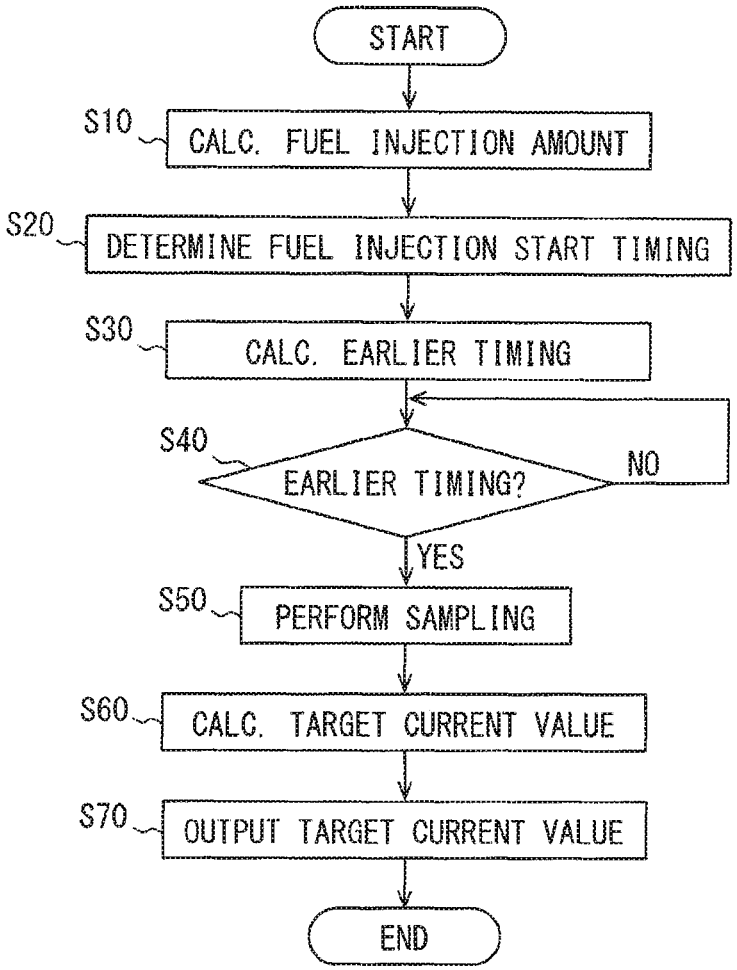
FIG. 3 is a flow chart to show a procedure of a microcomputer.

In the case of this modification, the microcomputer 11 performs the steps of S10 to S40 shown in FIG. 3. The microcomputer 11 outputs the trigger signal to the driver 12 after the step S40. Then, the driver 12 performs the step S50 and the step S60 shown in FIG. 3. Then, the driver 12 outputs the current to the injector 300 in place of step S70. Here, the earlier timing is found by the use of the fuel injection timing and the calculation time, and the calculation time is not a time required for the microcomputer 11 to calculate the valve opening output (target current value) but a time required for the driver 12 to calculate the target current value.

Other Modifications

In the first embodiment has been described the embodiment in which the injection control device of the present disclosure is applied to the engine ECU. However, an embodiment in which the injection control device is applied is not limited to the embodiment described above. As an ECU to which the injection control device is applied can be appropriately employed any ECU which controls an injector.

In the present embodiment has been described the embodiment in which the target current value corresponds to the peak current value, However, the target current value is not limited to the embodiment describe above but, for example, may be a change amount per unit time of the opening current, that is, a rising (gradient) with respect to time of the opening current.

In the present embodiment has been described the embodiment in which when the current flowing through the solenoid coil of the injector 300 reaches the peak current, the driver 12 controls the current flowing through the solenoid coil of the injector 300 in such a way that the hold current lower than the peak current continuously flows through the solenoid coil. However, the driver 12 may control the current flowing through the solenoid coil of the injector 300 in such a way that after the current flowing through the solenoid coil of the injector 300 reaches the peak current, the peak current continuously flows through the solenoid coil for a given time. In this case, the driver 12 controls the current flowing through the solenoid coil of the injector 300 in such a way that after the given time elapses, the hold current continuously flows through the solenoid coil.

What is claimed is:

1. An injection control device comprising:

a control section that controls an injector to inject fuel into an internal combustion engine; and a filter to which a sensing signal of a fuel pressure sensor to sense a pressure of the fuel to be supplied to the injector is inputted, wherein the filter includes a first filter and a second filter which is higher in a cut-off frequency than the first filter, the control section determines a fuel injection start timing, at which the injector is opened to start injecting the fuel into the internal combustion engine, by a crank angle and calculates a valve opening output to bring the injector from a closed state to an opened state on the basis of the sensing signal, and at an earlier timing, which is earlier than the fuel injection start timing by a calculation time required to calculate the valve opening output, the control section samples the sensing signal via the second filter and calculates the valve opening output on the basis of the sampled sensing signal.

2. The injection control device according to claim 1, wherein the valve opening output is a peak current value to bring the injector from the closed state to the opened state, or a gradient corresponding to a change amount of the current flowing through the injector with respect to time.

3. The injection control device according to claim 1, wherein the control section has a microcomputer and a driver, the microcomputer calculates the fuel injection start timing and the earlier timing and outputs a trigger signal, which instructs an operation of sampling the sensing signal via the second filter at the earlier timing, to the driver, and when the driver receives the trigger signal, the driver samples the sensing signal via the second filter and calculates the valve opening output on the basis of the sampled sensing signal.

4. The injection control device according to claim 1, wherein the control section samples the sensing signal via the first filter at a given period, and the control section calculates an amount of the fuel injected into the internal combustion engine on the basis of the sensing signal sampled via the first filter at the given period.

* * * * *